US008148624B2

(12) United States Patent
Raisanen

(10) Patent No.: US 8,148,624 B2
(45) Date of Patent: Apr. 3, 2012

(54) ACOUSTIC GUITAR CONTROL UNIT

(75) Inventor: Heikki Raisanen, Muurame (FI)

(73) Assignee: B-Band Oy, Vaajakoski (FI)

( * ) Notice: Subject to any disclaimer, the term of this patent is extended or adjusted under 35 U.S.C. 154(b) by 23 days.

(21) Appl. No.: 12/254,953

(22) Filed: Oct. 21, 2008

(65) Prior Publication Data

US 2009/0139390 A1 Jun. 4, 2009

Related U.S. Application Data

(63) Continuation-in-part of application No. 10/590,182, filed as application No. PCT/FI2005/000111 on Feb. 23, 2005, now abandoned.

(30) Foreign Application Priority Data

Feb. 23, 2004 (FI) ..... 20040277

(51) Int. Cl.
*G10H 1/32* (2006.01)
*G10H 1/00* (2006.01)

(52) U.S. Cl. ..... 84/737; 84/615; 84/626; 84/644; 84/743

(58) Field of Classification Search ..... 84/737
See application file for complete search history.

(56) References Cited

U.S. PATENT DOCUMENTS 3,812,432 A 5/1974 Hanson
3,901,120 A 8/1975 Youngquist
3,903,519 A 9/1975 Zega
4,122,751 A 10/1978 Calvin
4,126,070 A * 11/1978 Hill ..... 84/718
4,205,584 A 6/1980 Foerst
4,227,437 A 10/1980 Inloes et al.
4,252,048 A 2/1981 Pogoda
4,256,008 A 3/1981 Ryon
4,273,023 A 6/1981 Mercer
4,312,044 A 1/1982 Baba
4,318,327 A 3/1982 Toups
4,338,846 A 7/1982 Pogoda
(Continued)

FOREIGN PATENT DOCUMENTS

DE 1 547 594 11/1969
(Continued)

OTHER PUBLICATIONS

Communication Pursuant to Article 96(2) EPC dated May 2, 2007, for corresponding European Application 05 717 238.9.
(Continued)

*Primary Examiner* — Elvin G Enad
*Assistant Examiner* — Christopher Uhlir
(74) *Attorney, Agent, or Firm* — Katten Muchin Rosenman LLP

(57) ABSTRACT

A control unit for a musical instrument having a keypad and/or touch pad areas for controlling a signal processing unit. The control unit is preferably formed in a thin and elastic layered structure whereby touching electrode surfaces of the structure generates a charge, voltage or capacitance that is subsequently processed. The control unit includes a surface element, whereby settings and values of the signal processing unit can be changed and controlled by a user applying physical contact to the surface element. A user control device is further coupled to the control unit, and is operable under at least two forms of operation, and wherein the user control device is configured to (1) select an acoustic parameters and (2) adjust the selected acoustic parameter.

19 Claims, 6 Drawing Sheets

U.S. PATENT DOCUMENTS

| | | | | | |
|---|---|---|---|---|---|
| 4,434,697 | A | | 3/1984 | Roses | |
| 4,457,203 | A | | 7/1984 | Schoenberg et al. | |
| 4,476,767 | A | | 10/1984 | Katsuoka | |
| 4,484,506 | A | * | 11/1984 | Sato | 84/601 |
| 4,532,847 | A | | 8/1985 | Youngblood | |
| 4,589,324 | A | | 5/1986 | Aronstein | |
| 4,654,546 | A | | 3/1987 | Kirjavainen | |
| 5,070,754 | A | | 12/1991 | Adamson | |
| 5,323,680 | A | | 6/1994 | Miller et al. | |
| 5,371,511 | A | | 12/1994 | Atherton, Jr. et al. | |
| 5,388,496 | A | | 2/1995 | Miller et al. | |
| 5,396,827 | A | | 3/1995 | Miller et al. | |
| 5,408,914 | A | | 4/1995 | Breitweiser, Jr. et al. | |
| 5,455,381 | A | | 10/1995 | Juszkiewicz et al. | |
| 5,559,301 | A | * | 9/1996 | Bryan et al. | 84/653 |
| 5,561,257 | A | | 10/1996 | Cardey et al. | |
| 5,637,820 | A | | 6/1997 | Wittman | |
| 5,693,898 | A | | 12/1997 | Fishman | |
| 5,731,535 | A | * | 3/1998 | Hudak | 84/733 |
| 5,793,032 | A | | 8/1998 | Bard et al. | |
| 5,864,083 | A | | 1/1999 | Caren | |
| 5,877,444 | A | | 3/1999 | Hine et al. | |
| 5,917,437 | A | * | 6/1999 | Ojala et al. | 341/34 |
| 6,078,006 | A | | 6/2000 | Raisanen et al. | |
| 6,191,348 | B1 | * | 2/2001 | Johnson | 84/485 R |
| 6,242,683 | B1 | | 6/2001 | Raisanen | |
| 6,291,755 | B1 | | 9/2001 | Hine et al. | |
| 6,603,469 | B1 | | 8/2003 | Gettemy et al. | |
| 7,355,110 | B2 | * | 4/2008 | Nash | 84/601 |
| 2002/0005108 | A1 | * | 1/2002 | Ludwig | 84/600 |
| 2002/0108484 | A1 | | 8/2002 | Arnold et al. | |
| 2002/0163509 | A1 | * | 11/2002 | Roberts | 345/173 |
| 2003/0011577 | A1 | * | 1/2003 | Katsuki et al. | 345/173 |
| 2003/0196542 | A1 | | 10/2003 | Harrison | |
| 2004/0003703 | A1 | | 1/2004 | Chapman et al. | |

FOREIGN PATENT DOCUMENTS

| | | |
|---|---|---|
| DE | 27 16 910 | 10/1978 |
| DE | 10042300 | 3/2002 |
| DE | 10214796 | 10/2003 |
| EP | 0775049 | 5/1997 |
| JP | 2001013967 | 1/2001 |
| WO | 9606718 | 3/1996 |

OTHER PUBLICATIONS

Finnish Office Action dated Sep. 17, 2004, from corresponding Finnish Application FI-20040277.

International Search Report and Written Opinion dated Jul. 11, 2005, from the corresponding International Application PCT/FI2005/000111.

File History of U.S. Patent 587744 patented on Mar. 2, 1999.

File History of U.S. Patent 6291755 patented on Sep. 18, 2001.

* cited by examiner

ACOUSTIC GUITAR CONTROL UNIT

CROSS-REFERENCE TO THE RELATED APPLICATION

The present application is a continuation-in-part of U.S. patent application Ser. No. 10/590,182, titled "Acoustic Guitar Control Unit," filed Aug. 18, 2006, which is a U.S. National Phase Application of and claims priority to International Application PCT/FI2005/000111, filed Feb. 23, 2005, the disclosure of which is incorporated by reference in its entirety herein.

FIELD OF THE INVENTION

The present disclosure relates to musical instruments control units, and particularly to control units configured for use in acoustic guitars and related acoustical instruments.

BACKGROUND OF THE INVENTION

Acoustic guitars have been provided with pickups and preamplifiers for many years. The preamplifiers typically have a control unit which for example, may include means for controlling volume, bass, middle range and treble. The controllers are typically slide or rotary potentiometers and various kind of switches. In some preamplifiers, displays, such as LCD displays, may be used to show various parameters.

Installing current preamplifiers require typically a relatively large hole that has to be routed into the side of the guitar, into which the control unit is installed. Because acoustic guitars are often very valuable and sensitive for changes, large holes make them less valuable and their sound characteristics may become worse.

During the past years, there have been different configurations offering suitable controls to adjust the preamplifier parameters having as few holes as possible, or alternately having no holes at all. Companies like L.R. Baggs and Shadow have, for example, manufactured different control units that can be installed into the guitar sound hole itself. However, the problem in such cases is that the controllers become very small, the slide controls are difficult to use, and/or contain limited options for controlling numerous parameters, due to the limited size. In electric guitars there have been ideas to integrate controllers to the pick guard. As an example, US Patent Publication No. 2004/0003703 describes a pick guard with built in controllers.

U.S. Pat. No. 5,917,437 discloses a keyboard structure that is resistant to hard impacts where, under a solid and hard surface, there is a transducer element with a pattern, corresponding a keyboard, that is silk-screen printed with silver paste. In an exemplary structure disclosed herein, a so-called electret bubble film is used, which is described generally in U.S. Pat. No. 4,654,546. Under this structure, a constant electric charge can be injected into a dielectric electret bubble film, such as polypropene, and may include flat and/or torn gas blisters.

It is noted that the configuration disclosed in U.S. Pat. No. 5,917,437 has many disadvantages when applied to a versatile device, especially one having thin construction and is mass-produced. The prior art does not allow having as thin and economical transducer structure as possible, nor does the prior art provide a configuration for having economical, small current consumption in the electronics. Additionally, the prior art does not disclose the use of glide controllers for assisting users in adjusting electro-acoustic parameters.

A method is disclosed in WO publication 9606718 for swelling a foamed plastic film wherein the amount of gas it contains can be increased. EP Patent publication EP-B1-0775049 discloses how a thin film, including flat gas bubbles and oriented biaxially is charged electrically so that partial discharges may occur inside it.

Other prior art discloses keyboards arrangements that rely on capacitance to effect voltage flow through a connection when the surface is touched by a user. Additionally, piezoelectric keypads may be formed with laminated layers or printable paste or paint that includes piezoelectric crystals, to enable a turn-on voltage or charge. Examples of such keyboards are ALGRA Dynasim™ and ALGRA Dynapic™ keyboards currently being produced by ALGRA Ltd in Switzerland.

SUMMARY OF THE INVENTION

The present disclosure provides exemplary embodiments that address many of the disadvantages of the prior art by providing a thin and elastic control unit of a new type having no mechanical electrical components. Under a preferred embodiment, the thin and elastic digital electronic control unit is digital. Installation of the control unit is particularly advantageous, as the boring or drilling of holes in acoustic musical instruments becomes unnecessary.

An acoustic guitar control unit having a control unit and a display and/or mounted LEDs is also disclosed herein to provide visual information of the adjustment of the controllers. Under the preferred embodiment, adjustments are made digitally with one or more touch-sensitive slide controllers. Thus, operation of the keyboard for the controller can be carried out using pressure applied to the keyboard. As is discussed in more detail below, the configuration disclosed herein minimizes the number of preamplifiers the control unit needs, optimizes processor calculations, and provides economical manufacturing costs. Under the preferred embodiment, the control unit is advantageous for use in acoustical instruments, such as an acoustic guitar.

A preferred embodiment of the control unit disclosed herein has a structure wherein a signal electrode pattern has been arranged on one surface of the transducer film. Preferably, one row having several sequentially-arranged signal electrode areas are coupled together with resistors or capacitors. Thus, the number of preamplifiers needed can be minimized and a smaller current consumption is achieved.

In this embodiment, the transducer film is an electret bubble film, wherein the amount of gas that the gas bubbles contain before it is charged with a strong electric field has been increased to over 50% of its volume, for example, by swelling it. The transducer can also be piezoelectric material such as polyvinylidene fluoride (PVDF) or printed piezoelectric paint. While the transducer has a very thin structure, it also provides clear analog voltage information about the area that has been pressed, and the strength of pressing. When the whole element is thin and only a thin protective film is arranged on it, even light pressing is enough to produce a good signal-to-noise ratio. Thus, the control unit becomes very flexible and can follow the round sides of an instrument (i.e., acoustic guitar).

The microcontroller and/or signal processor unit in the exemplary embodiment comprises an electronics part having a suitable algorithm with which the amplification of the control unit's own preamplifiers can be increased and/or with which the touch sensitivity appropriate for the user may be adjusted by the user from the interface of the device or automatically.

The control unit should be wear-resistant and have no separate moving parts, and its outer surface is preferably a smooth plastic film or even thin metal film. This configuration makes it easy to keep clean and tolerate exposure to liquid. The outer film may also have a pattern including visual information and it can be easily changed, for example, from one to a different color.

In the preferred embodiment, the signal and ground electrode layers and the plurality of transducer films are arranged so that the number of electronic components needed is considerably reduced, and a maximal operational accuracy is achieved, and easily processable signal information is produced, without the need for complex algorithms that require great amount of calculating capacity.

Furthermore, the electrode materials should preferably be printed directly onto the surface of the transducer film, onto its both sides, without heat with only silver paste that is dried with UV light, with the resistors arranged between them directly onto the surface of the transducer film. Accordingly, the structure control unit becomes very thin and elastic.

During manufacturing, the transducer element material can be optimized and the loss can be minimized. Additionally the transducer will be less sensitive for different disturbances and breaking.

Under the exemplary methods disclosed herein, a film-like control unit with different size and form that are very well protected against electrostatic discharges and electromagnetic noise, and which from their outer surface are of smooth plastic film, can be manufactured from the element material very fast and economically.

The control unit can also be arranged under the display because it is very sensitive for pressing. The characteristic features of the control unit and method for its manufacture are presented below in the enclosed independent claims.

BRIEF DESCRIPTION OF THE DRAWINGS

Other objects, features, and advantages will become apparent from the following detailed description of certain advantageous embodiments when read in conjunction with the accompanying drawings, where the same components are identified by the same reference numerals, in which.

DETAILED DESCRIPTION OF THE INVENTION

Figure 1:
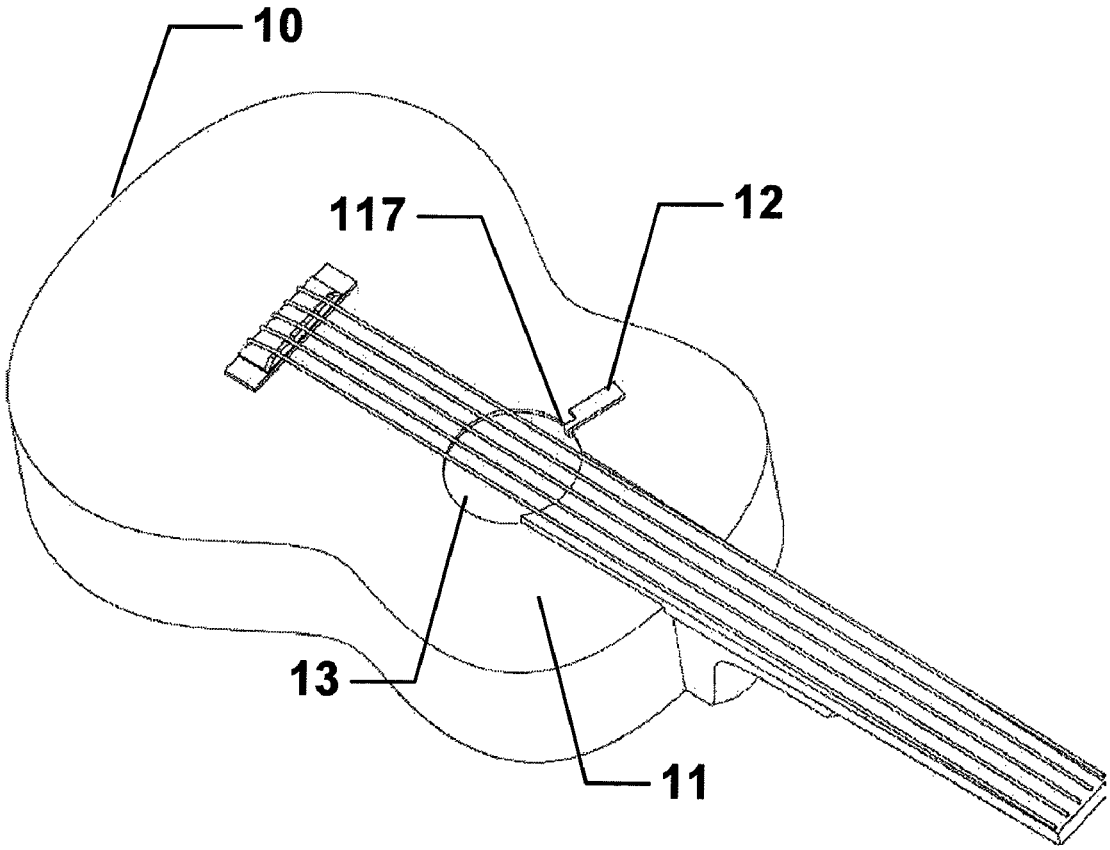
FIG. 1 illustrates an acoustic guitar wherein a control unit according to an exemplary embodiment is arranged in the top of the guitar adjacent to the neck.

FIG. 1 discloses an exemplary embodiment illustrating an acoustic guitar 10, wherein into the top 11 adjacent to the neck is installed a control unit 12. At the top of the guitar, there is a sound opening 13, wherefrom a band-like cable region 117 from the control unit continues into inside of the guitar and the electronic unit being installed therein.

Figure 2:
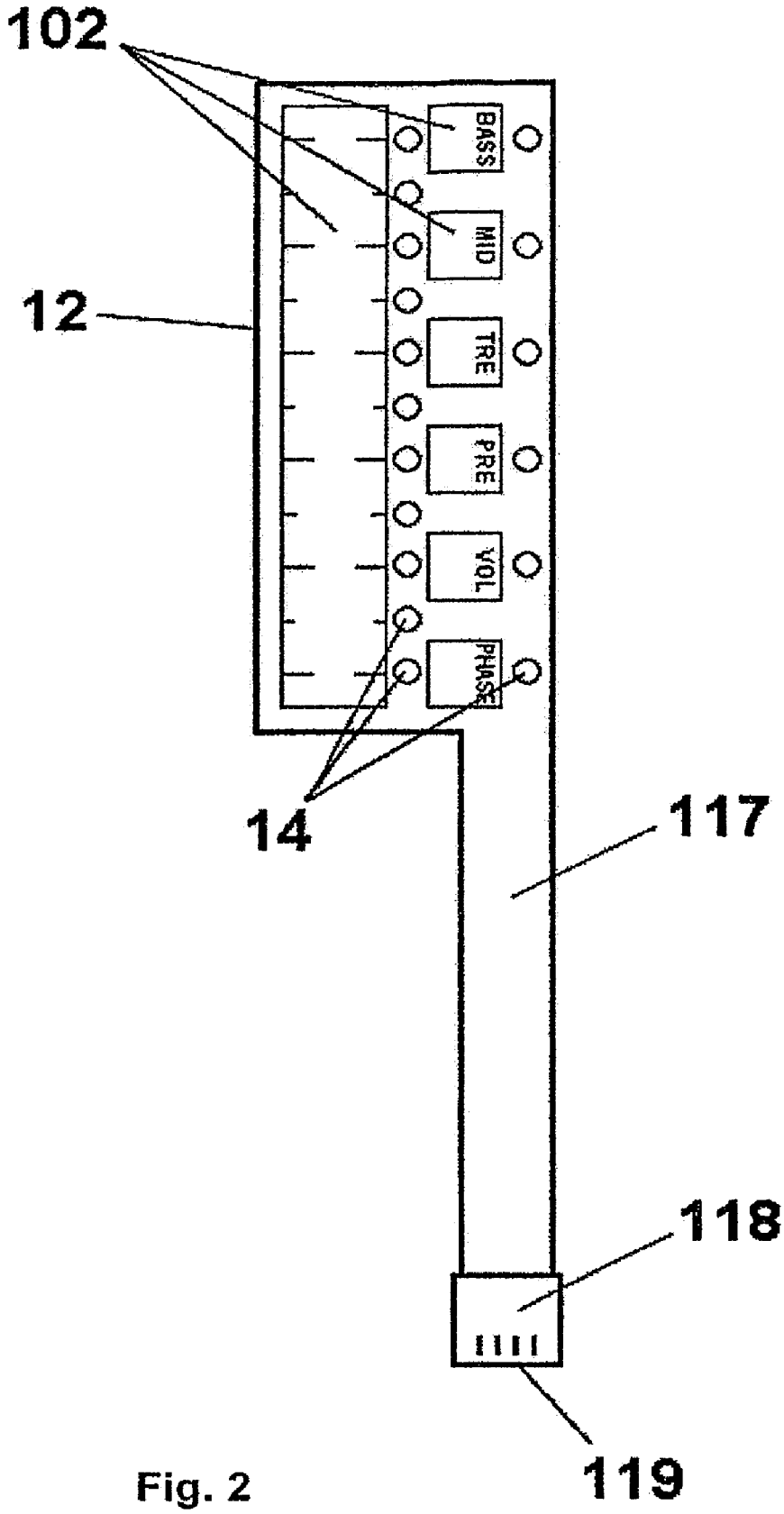
FIG. 2 illustrates a top view of the control unit according to the exemplary embodiment.

In the view depicted in FIG. 2, the control unit is shown from a top view. Utilizing LEDs 14, the user is given visual response information as well as information regarding the operations and their adjustments. The printed symbols 102 indicate where a user should press in order to adjust a certain operation.

Figure 3A:
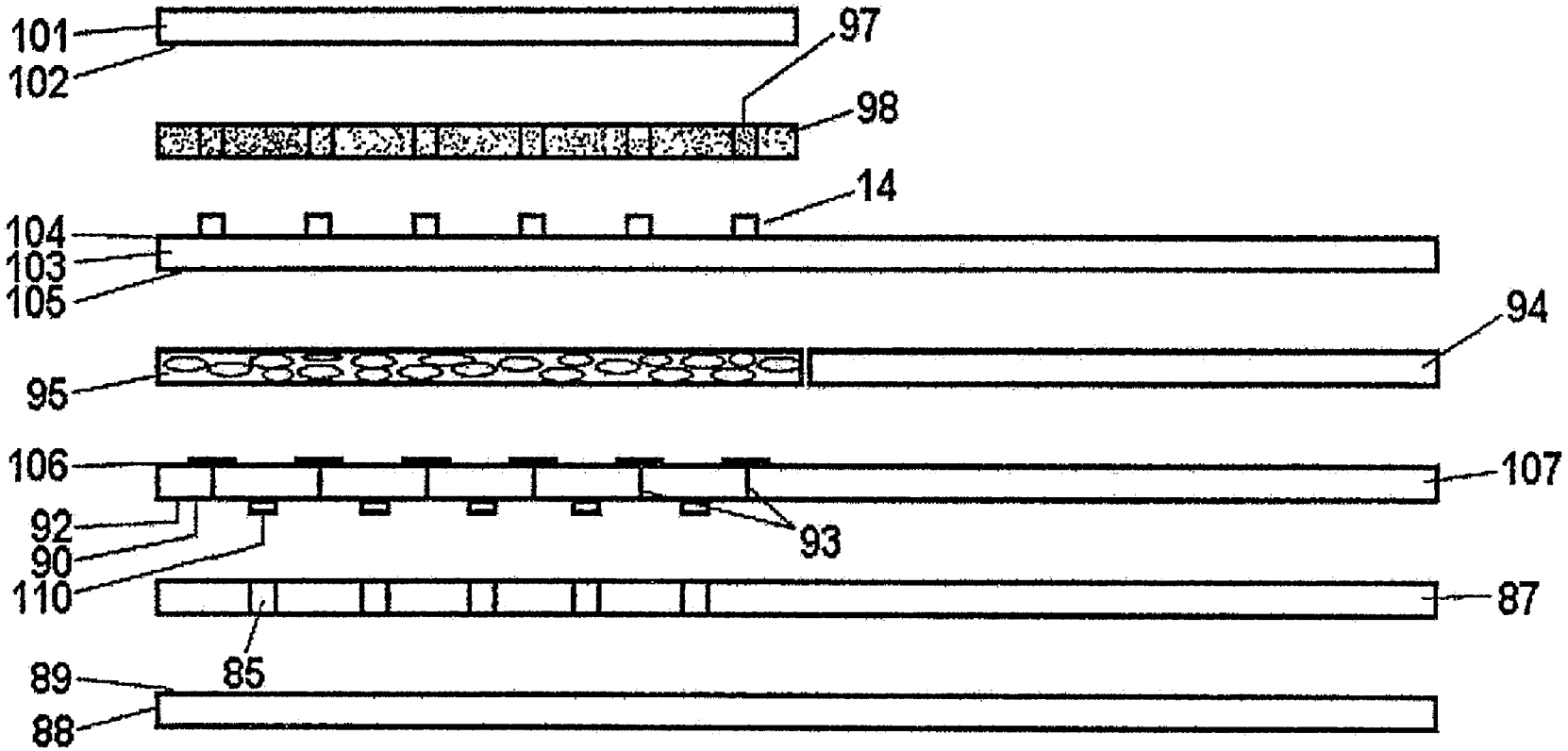
FIG. 3*a* illustrates a cross section of the control unit according to the exemplary embodiment.

In a cross section view illustrated in FIG. 3*a*, different layers of a touch-sensitive control unit are shown, where the total thickness of them preferably being in the range of 2 mm. The outer surface layer 101 is preferably a smooth, wear-resistant unitary surface, for example, polyester of thickness in the range of 0.1 mm. The surface layer 101 can also be silicon a molded or injection-molded plastic, hard or elastic soft element with bosses or grooves arranged into it in order to give a better touch to the user of the place being pressed.

Symbol patterns 102 of the touch pad are preferably arranged on the under side of the film 101 by silk-printing. The element has a layer 103 of thin plastic film, for example, polyimid or polyester, on the upper surface 104 of which has been arranged conductors of LEDs 14, by etching or by silk-printing. Because the LEDs 14 are at their thinnest in the order of 0.2 mm, it is reasonable to arrange a film 98 between the layers 101 and 103 of some material that is suitably thick and elastic.

It may even be soft like cellular plastic, into which holes 97 have been cut in the places for LEDs 14. On the under side of the film 103, a ground electrode pattern 105 is arranged that covers the entire area. When going even deeper, the next layer is an electromechanical-type layer 95 which preferably is Emfit® film the use and properties of which has been in detail described for example in U.S. Pat. No. 6,078,006 and U.S. Pat. No. 6,242,683, which are incorporated by reference in their entirety herein.

Figures 3B, 3C:
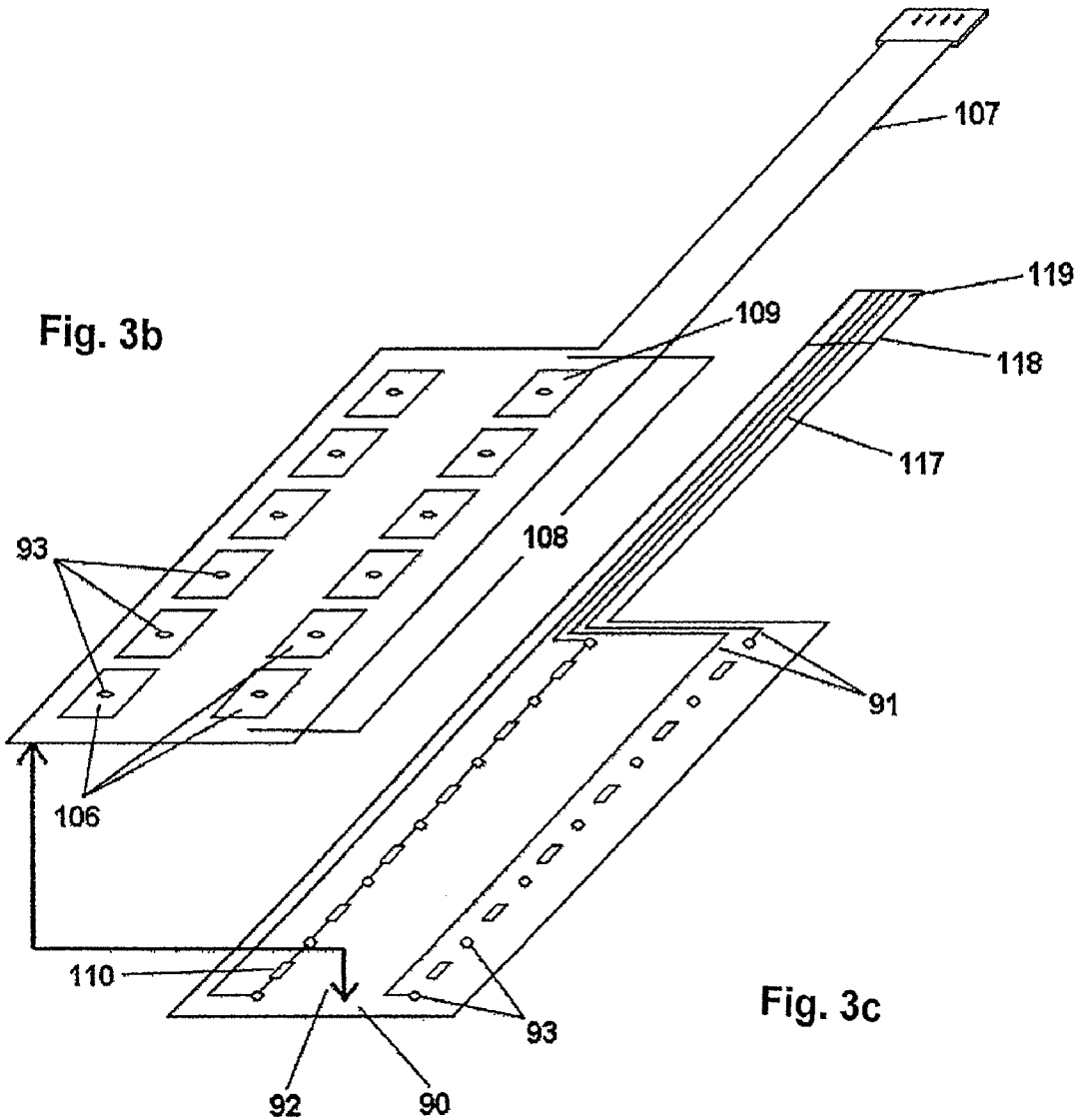
FIG. 3*b* illustrates a top view of one of the most relevant layers of the control unit according to the exemplary embodiment.
FIG. 3*c* illustrates the layer shown in FIG. 3*b* from an underside view.

Adjacent to the film 95 there is an isolation 94 which principally can also be arranged by silk-printing. Instead of Emfit® film, some other suitable elastic, uncharged material can be used, and thus only the capacitance change may be utilized in the calculations described below. Such a material is however not so exact and the structure does not become so thin. Next in the structure there is the signal electrode pattern 106 of the Emfit® film arranged on the upper surface of a plastic film 107, which also can be a printed circuit card. In detail this layer is described in FIG. 3*b*. It should be noted that the signal electrode pattern can have a desired form, and the different areas can be rectangular, oval or round.

The signal electrode pattern comprises areas 106, and when pressed, the element identifies the pressing by generating a charge impulse. Under an advantageous arrangement, the element is formed into a row 108 comprising several subsequent areas 106, wherein the areas 106 are somewhat narrower than the finger width, and which areas are very near each other, preferably in the range of 0.5 mm.

The purpose of this row 108 is to form a sensor matrix that senses the place in the row that has been pressed, as well as the movement of the finger along the row. The purpose of this is to adjust a desired operation at a certain moment, such as the bass frequencies, treble frequencies, volume, etc. Between every area of the row 108, a resistor is arranged by silk-printing or by using a miniature chip-resistor 110, and only the outer areas 109 of the row have been connected to the preamplifiers and further to the microcontrollers.

When necessary, the layer 107 can either be of this plastic layer, like polyester or polyimid, or of thin circuit board material. However a hole 93 has been arranged in the place of each area 106, from which each area is coupled electrically to the lower surface 92. On the lower surface 92 there is arranged, preferably by silk-printing, a transparent isolation layer 90 on the conductors. The ground plane 89 in the embodiment is utilized for noise protection, and can be printed on the isolation 90, or it can be arranged on the surface of its own plastic film 88. If the resistors 110 used are high it is preferable to use under the layer 107 a layer like 87 which is preferably corresponding to the layer 98, i.e., holes 85 have been cut into it so that the resistors do not cause any bosses. All the necessary conductors 91 are preferably arranged in one place further to a band 117, at the end 118, of which connectors 119 can be crimped for coupling to a preamplifier.

When necessary, all electronic components can be arranged into the same structure. By arranging enough space, all the electronics needed by the signal processing unit can be accommodated on the lower surface 92. Thus, a multiple layer circuit plate would be used to replace the layer 107, and the noise protection needed by the Emfit® film would be arranged in the middle layer of the circuit board. Accordingly, the structure becomes easily thicker but nevertheless still much thinner than the traditional preamplifiers. If it is acceptable to make the hole for the preamplifier in the side of the guitar, a very durable and economical new type of preamplifier can be manufactured.

Surface film 101 can, if necessary, be replaced by thin and flexible display such as an OLED (organic light emitting display) display or a thin and flexible LCD display, such as a LED curtain, LED scrim, transparent LED, or any suitable LED module mounted either on strands of fabric or on a fine, lightweight grid. Using such displays, all the symbols and visual information can be made variable, and a multiple stage/level interface can be achieved. The advantages of it are, for example, that in the basic state, only the most necessary controllers can be seen, and when it is necessary to adjust a single operation, one chooses the operation from the interface, and the display is changed accordingly, like is at mobile phones for example.

The display can also be a hard glass traditional LCD display if the device is installed on a straight surface. They can also be so thin that when pressed, pressure is generated so precisely that so called crosstalk does not exist. Further, when pressure-sensitive Emfit® electret bubble film is used that is not sensitive to bending, the crosstalk problem is also minimized.

Suitable glue is used between different film layers which, in a preferable manufacturing method, is water-based and very fluent. The glue can be spread on the film surfaces using techniques such as roll-to-roll laminating using a so-called raster roller, and using sheet lamination, for example, with a brush. Furthermore, an adhesive sheet film can be used, manufactured, among others, by 3M™. Lamination can be performed as a whole or as a part of sheet lamination, and partly roll-to-roll. More specifically the lamination, alignment, and cutting have been described in the above mentioned patent documents.

As mentioned above, areas 106 of the rows are coupled with resistors or capacitors to each other, and only the outermost areas with connectors 119 may be coupled to the circuit board wherefrom they are further coupled to a suitable preamplifier and further to a microcontroller. Due to the resistors or capacitors 110 between the electrode areas, when a single area is pressed, the charge amplitude is identified with different values by preamplifiers depending on the place in the row 108 the area 106 is located. Thus the pressed area can be calculated separately with a microcontroller, for example Microchip PIC16F88-I/SO, and the digital signal processing circuits can be controlled accordingly and a desired operation can be adjusted.

With this kind of coupling, the number of amplifiers needed and the costs for electronics can be minimized. It is understood that the aforementioned description is only an example of how the electronic components can be arranged, and the switching diagram can vary greatly due to the desired operations and variety of the control possibilities.

When the transducer film is an electrically charged Emfit® electret bubble film, the voltage corresponding to the pressing is directly proportional to the pressing force. In this case, the voltage amplitude can also be used in the control of the operations of the device. For example, strong pressing in a certain area would change the operation differently from a light pressing in the same area.

Because in the element in the exemplary embodiment has an electrically charged electret bubble film used for a transducer film, every pressing has en effect that a voltage is generated between the signal electrode and the ground plane. This voltage can be, for example, rectified with a rectifier and connected to an accumulator of the device, whereby the operation time of the accumulator with the same charging becomes longer.

Further correspondingly manufactured transducer elements can be arranged into the device, for example on its outer surface, that are only used to generate a voltage when the device is touched and which is further rectified to the accumulators of the device. Preferably these elements have several transducer films, for example, 5 or even 10 transducer films can on each other with opposite sides against each other.

If the device comprises a display and/or touch pad, based on electret bubble film, it may be exposed to high temperatures, resulting in a possible weakness of sensitivity. As such, the weakening of sensitivity would worsen the touch feeling of the keypad, and thus require harder pressing by the user. Accordingly, the device may include a processor which repairs the case automatically with a suitable algorithm. For example, a temperature measuring sensor is placed in the device, whereby, based on the information from the sensor (temperature and time), a certain threshold may be monitored to see if it is exceeded (e.g., 50° C.). Once exceeded, the algorithm would automatically begin to correct the gain of the preamplifier for compensation purposes. Also, as temperature become higher and/or last for a longer time, the algorithms would adjust corrections accordingly.

As an example, an algorithm variable may be correlated with temperature exposure, and may be stored in an EEPROM or corresponding non-volatile memory under an exemplary embodiment. As the variable increases, the temperature adjustment would also increase to compensate for the temperature increase across the time period measured, in order to compensate the temperature exposure below a certain threshold value.

This value can be the basis for determination of the sensitivity according to which the basic setting of the temperature is adjusted. In other words, a certain register is increased when the temperature is higher than a certain value according to how much this value has been exceeded. This is performed using certain time intervals, e.g., four times per hour.

The current consumption can also be minimized under the following advantageous embodiment. The device may be programmed to "wake up" at a given time (e.g., every 15 minutes) in order to sample the temperature and perform integration over a short time period (e.g., milliseconds). The processor(s) should be configured with a timer that runs while the processor is in a "sleeping" minimum current state. When the timer is reset, a wake up mode is initiated, and the processor executes an interruption routine where the temperature damage integrator would be placed.

The thermal time constant of the temperature sensor of the device should be high enough so that it is fixed into a body that has enough heat charging capacity. The keypad may have an automatically calibrating amplification. The device may also observe what kind of signals are coming from the keyboard and adjust the amplification accordingly, preferably using small change increments. The device may also have a combination of these two and possibly use a reference sensor, such as a piezoelectric crystal with high ambient temperature tolerance.

Figure 4A:
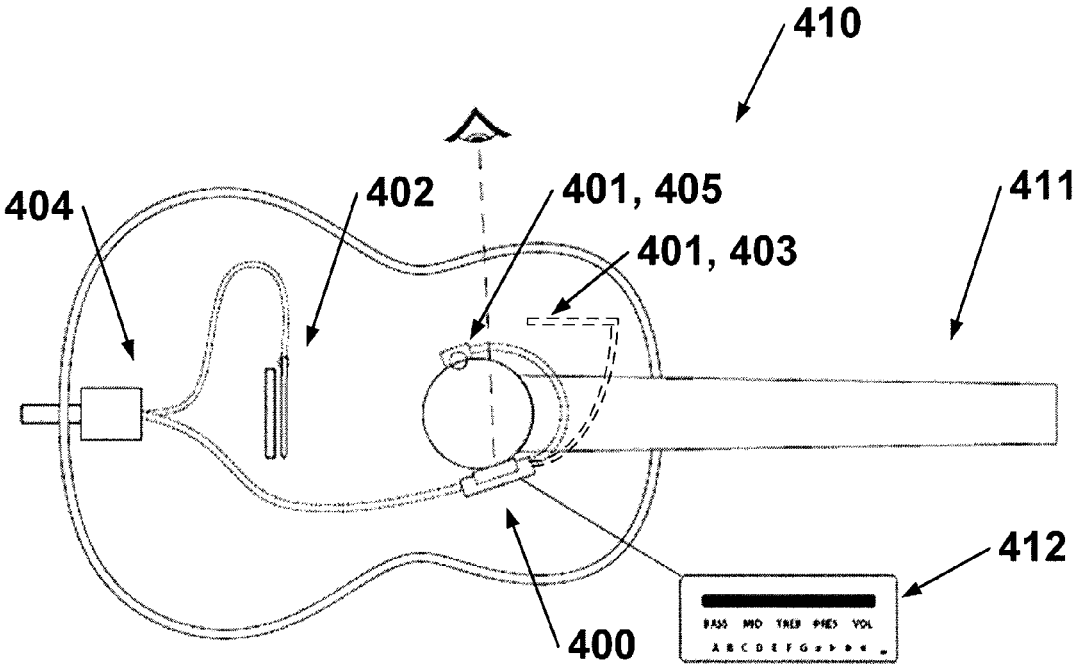
FIG. 4*a* illustrates an acoustic guitar and control unit arrangement according to another exemplary embodiment.

FIG. 4*a* illustrates another exemplary embodiment, where an acoustical instrument (i.e., guitar) has a control unit 400 installed just underneath the surface of the instrument's body 410, in a sound hole, preferably near the neck 411, in order to the readily visible by the user (shown as dashed line in FIG. 4*a*). The face of the control unit 400, which would be visible to the eye of the user during operation, is shown in 412, and is preferably in the form of an LED display. Control unit 400 is operatively coupled to a digital-analog (D/A) preamplifier 404, which if further coupled to a transducer, or "pickup", illustrated as 402. As described above, the control unit face 412 may be configured to accept inputs using pressure from a user's hand. However, as illustrated in FIG. 4*a*, a switch 401, preferably a rotary encoder switch, is coupled to the control unit for additional user control.

Under a preferred embodiment, the switch has multiple forms of operation as a user control device that allow the user to scroll through functions displayed on the control unit face. As shown in FIG. 4*a*, exemplary functions displayed on the control unit face include "bass, mid, treb, pres and vol", as well as tuning keys "A-G" and functions "#, ▶, ●, ◀, and □." The tuner circuitry should be embedded into the same microcontroller on control unit 400, and should have sufficiently low power consumption, preferably in the range of 7-10 mA.

Under the rotary encoder switch embodiment, a user would "roll" the wheel to scroll between the different functions. Once a desired function is selected, the user would exert direct pressure on the switch to enter the desired function. Once entered, the function may be adjusted by the user using the switch. Thus, as an example, a user may scroll to bass, and press the switch to adjust bass frequencies. Preferably a bar (displayed at the top of face 412 in FIG. 4*a*) would display levels pertaining to the bass frequencies, and the user could increase or decrease the levels according to the visual indicia provided.

The configuration provided in FIG. 4*a* provides numerous advantages. Since the face 412 of control unit 400 appears in the sound hole on the side opposite the user, the display lights would be readily visible to a user, but conspicuously hidden to an audience. The embodiment utilizing a digital rotary encoder would preferably replace the Emfit® sensor for controlling the controller and D/A preamp. This way, the rotary encode would provide increased access for a user, while providing ease of installation on the instrument.

Figure 4B:
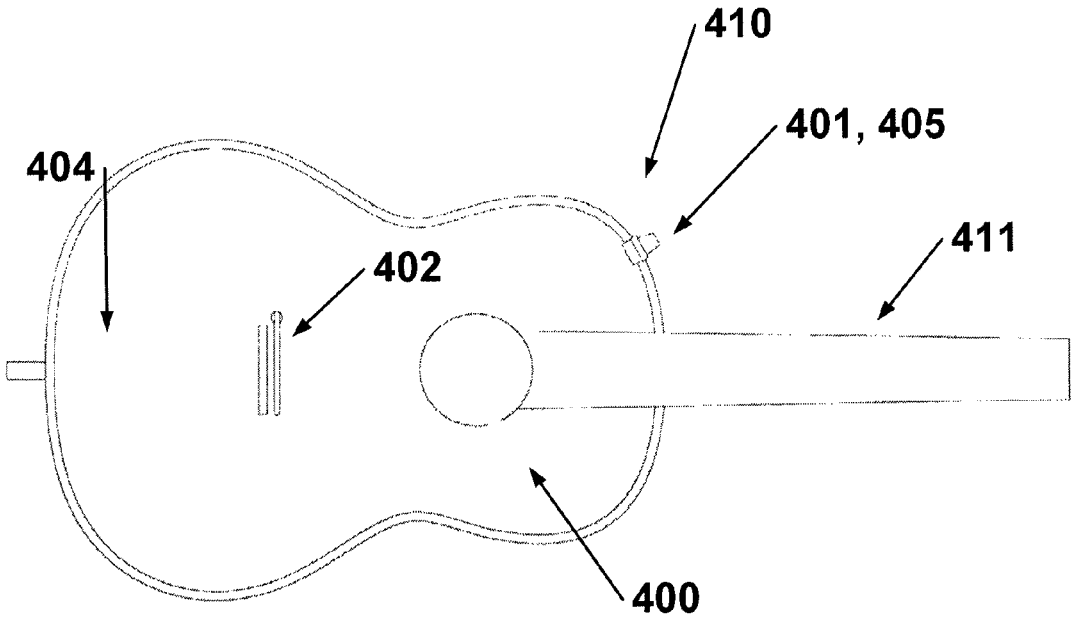
FIG. 4*b* illustrates an acoustic guitar and control unit arrangement according to yet another exemplary embodiment.

It is understood that various modifications may be made to the embodiment of FIG. 4*a* without departing from the scope of the present disclosure. For example, FIG. 4*b* illustrates the same features disclosed in FIG. 4*a*, except that a rotary switch 405 (e.g., vertical potentiometer) is configured on an external surface of instrument body 410. Rotary switch 405 may also be a digital rotary encoder, such as the one illustrated in FIG. 4*a*. Alternately, switches 405, 403 may be any other suitable switching element (digital potentiometer, ribbon switch, etc.) capable of performing the aforementioned functions. Also, control unit 400 may also be configured to select and execute different functions using a variety of different means, according to the application used. For example, users may be able to select functions using a series of pressing actions upon the switch, that can separately, or in combination with scrolling features provided by the switch used, scroll through and select desired functions.

Thus, various forms of operation may be supplied to the control unit 400, including, but not limited to the following: (1) pressure applied the control unit, (2) pressure applied to the control unit over a predetermined time, (3) pressure applied to the control unit in multiple instances over a predetermined time, (4) rotating an element on the control unit, (5) pressure applied the control unit in combination with rotating the element on the control unit, (6) pressure applied the control unit over a predetermined time in combination with rotating the element on the control unit, and (7) pressure applied to the control unit in multiple instances over a predetermined time in combination with rotating the element on the control unit. Additionally, a memory (not shown) may be provided with the control unit 400 for storing and recalling settings for a user after the instrument is unplugged or otherwise disconnected. Additionally, various presets may be provided to allow users to quickly access desired acoustical properties for the instrument. Such presets would be added to the face 412 of control unit 400 for visual indication of the preset used. For the sake of simplicity, the presets are not show on face 412 of FIG. 4*a*.

It is apparent for a skilled person that the different embodiments are not limited to the examples presented above but they can be varied according to the enclosed claims. The invention can be applied to be used also in other keypads. Although various embodiments of the present invention have been described with reference to a particular arrangement of parts, features and the like, these are not intended to exhaust all possible arrangements or features, and indeed many other embodiments, modifications and variations will be ascertainable to those of skill in the art.

What is claimed is:

1. An apparatus for a musical instrument, the apparatus comprising:

a control unit comprising a signal processor and a flexible display face, the signal processor processing electro-acoustic signals according to a plurality of acoustic parameters, the display face comprising a first electronic visual indicia of the plurality of acoustic parameters; and a user control device operatively coupled to the control unit, the user control device selecting one of the plurality of acoustic parameters in the control unit using a first form of operation on the user control device and adjusting the selected acoustic parameter in the control unit utilizing the user control device using a second form of operation on the user control device, the second form of operation differing from the first form, wherein the display face comprises a second electronic visual indicia showing a level of adjustment provided from the user control device on the selected acoustic parameter;

wherein the control unit comprises a flexible structure able to be mounted to a curved surface of the musical instrument, the flexible structure comprising the flexible display face, when mounted to the curved surface the display face comprises a curve; the control unit further comprises a plurality of electrode surfaces having at least one active transducer material between each plurality of electrode surfaces to form a thin and elastic layered structure, said active transducer material comprising one of a (1) charged electret film, (2) a polarized cellular electret film, (3) PVDF, and (4) piezoelectric paint.

2. The apparatus of claim 1, wherein the control unit is configured to be mounted on an inside surface of the musical instrument, where the display face is visible to a user of the musical instrument.

3. The apparatus of claim 1, wherein the user control device comprises a switching element.

4. The apparatus of claim 3, wherein the switching element is pressure-activated responsive to one of (1) pressure applied the control device, (2) pressure applied to the control device over a predetermined time, (3) pressure applied to the control device in multiple instances over a predetermined time, (4) rotating an element on the user control device, (5) pressure applied the control device in combination with rotating the element on the user control device, (6) pressure applied the control device over a predetermined time in combination with rotating the element on the user control device, and (7) pressure applied to the control device in multiple instances over a predetermined time in combination with rotating the element on the user control device.

5. The apparatus of claim 4, wherein the switching element comprises one of a rotary encode switch and a digital potentiometer.

6. The apparatus of claim 1, further comprising a memory, operatively coupled to the control unit, configured to provide preset acoustic parameters for selection.

7. The apparatus of claim 1, wherein the control unit further comprises tuning circuitry for acoustically tuning the musical instrument.

8. The apparatus of claim 1, wherein the acoustic parameters comprise at least one of acoustic equalization, volume, and tuning.

9. The apparatus of claim 8, wherein the display face provides electronic visual indicia relating to acoustic equalization, volume, and tuning.

10. The apparatus of claim 1, wherein the display face comprises an LED.

11. An apparatus for a musical instrument, the apparatus comprising:

a control unit comprising a plurality of electrode surfaces having at least one active transducer material between each plurality of electrode surfaces to form a thin and elastic layered structure, said active transducer material comprising one of a (1) charged electret film, (2) a polarized cellular electret film (3) PVDF, and (4) piezoelectric paint;

a signal processing unit, operatively coupled to the control unit, wherein the signal processing unit is configured to process a plurality of acoustic parameter; and a flexible surface element, operatively coupled to the control unit, said surface element comprising a plurality of touch pad areas corresponding to visual indicia of the plurality of acoustical parameters, wherein the surface element is configured to be reactive to physical contact by a user to produce electrical signals that are transmitted to the signal processing unit to effect selection and adjustment of an acoustical parameter, wherein different acoustical parameters are selected and adjusted in accordance with the different touch pad areas receiving physical contact;

wherein the control unit comprises a flexible structure able to be mounted parallel to a curved surface of the musical instrument, the flexible structure comprising the flexible surface element.

12. The apparatus of claim 11, wherein the physical contact comprises at least one of (1) physical contact having a first contact pressure, (2) physical contact having a second contact pressure that is different from the first contact pressure, and (3) sliding a point of physical contact across at least one of the plurality of physical contact areas.

13. The apparatus of claim 11, the control unit comprises at least one sensor matrix element, said sensor matrix element comprising signal electrodes, where at least some of the signal electrodes correspond to the touch pad areas, said signal electrodes being coupled together using one of (1) resistors and (2) capacitors, wherein the signal electrodes arranged in the outermost areas of the sensor matrix element are operatively coupled to at least one preamplifier.

14. The apparatus of claim 13, further comprising an electronic switching circuit, operatively coupled to the signal processing unit, wherein the switching circuit is configured to adjust gain of the at least one preamplifier in order to set a touch sensitivity for at least one of the touch pad areas.

15. The apparatus of claim 14, wherein the electronic switching circuit comprises a computer processor.

16. The apparatus of claim 15, wherein the switching circuit comprises a temperature measurement apparatus.

17. The apparatus of claim 11, wherein the active transducer material is arranged in the form of one of (1) a film and (2) paint.

18. An apparatus for a musical instrument, the apparatus comprising:

a control unit comprising a signal processor and a display face, the signal processor processing electro-acoustic signals according to a plurality of acoustic parameters, the display face comprising a visual indicia of the plurality of acoustic parameters, the display face being sufficiently flexible to be bent into a curved shape; and a user control device for controlling the control unit;

wherein the control unit comprises a plurality of electrode surfaces having at least one active transducer material between each plurality of electrode surfaces to form a thin and elastic layered structure, said active transducer material comprising one of a (1) charged electret film, (2) a polarized cellular electret film, (3) PVDF, and (4) piezoelectric paint.

19. The apparatus of claim 18, further comprising a surface element, operatively coupled to the control unit, said surface element comprising a plurality of touch pad areas corresponding to visual indicia of the plurality of acoustical parameters.

* * * * *